United States Patent [19]

Jennings et al.

[11] Patent Number: 4,541,365

[45] Date of Patent: Sep. 17, 1985

[54] METHOD AND APPARATUS FOR SUPPLYING FEEDWATER TO A FORCED FLOW BOILER

[75] Inventors: William S. Jennings, West Covina; Clark E. Fegraus, Laguna Beach, both of Calif.

[73] Assignee: Clayton Manufacturing Company, El Monte, Calif.

[21] Appl. No.: 661,035

[22] Filed: Oct. 15, 1984

[51] Int. Cl.[4] ..... F22D 5/26

[52] U.S. Cl. ..... 122/451 R; 122/451 S; 122/451.1; 417/388

[58] Field of Search ..... 122/412, 451 R, 451 S, 122/452, 456, 448 S; 417/388, 395

[56] References Cited

U.S. PATENT DOCUMENTS

| | | | |
|---|---|---|---|
| 2,062,925 | 12/1936 | Ofeldt | 122/451 S |
| 2,372,087 | 3/1945 | Karassik | 122/451 R |
| 2,987,053 | 6/1961 | Arant | 122/451 S |
| 3,092,086 | 6/1963 | Profos | 122/451.1 |
| 3,105,468 | 10/1963 | Gardam | 122/451 R |
| 3,175,541 | 3/1965 | Hottenstine | 122/451 S |
| 3,612,005 | 10/1971 | Lythe | 122/451 S |
| 3,828,737 | 8/1974 | Fujii et al. | 122/451 S |

OTHER PUBLICATIONS

Instruction Manual, Steam Generator, Models EO-100, EG-100, EOG-100, and Model E-302, Clayton Manufacturing Company, El Monte, California.

*Primary Examiner*—Henry C. Yuen

*Attorney, Agent, or Firm*—Jackson & Jones

[57] ABSTRACT

An apparatus and method of supplying feedwater to a forced flow boiler or the like as described. A positive displacement pump having a plurality of discrete pumping elements is arranged to pump feedwater from an inlet to the boiler. The pump includes bypass valves which, when open, disable the pumping action of an associated pumping element. Control means responsive to the demand for water in the boiler are arranged to disable a selected number of the pumping elements so that the rate of water supplied by the remaining elements, if operated continuously, would just exceed that required. The control means is further arranged to disable at least one of the remaining pumping elements on a periodic basis so that the ratio of time that the element is enabled to the time for one period multiplied by the water flow rate supplied by said element, if operated continuously, equals the difference between the total demand for water and the rate supplied by the pumping elements enabled on a full-time basis.

23 Claims, 6 Drawing Figures

| BY-PASS VALVE | 100% WATER DEMAND | 80% WATER DEMAND | 65% WATER DEMAND | 50% WATER DEMAND | 35% WATER DEMAND | 20% WATER DEMAND |
|---|---|---|---|---|---|---|
| 116 | CLOSED | CLOSED/OPEN DUTY CYCLE = 20% | CLOSED/OPEN DUTY CYCLE = 60% | OPEN | CLOSED/OPEN DUTY CYCLE = 40% | CLOSED/OPEN DUTY CYCLE = 80% |
| 134 | CLOSED | CLOSED | OPEN | OPEN | OPEN | OPEN |
| 136 | CLOSED | CLOSED | CLOSED | CLOSED | OPEN | OPEN |
| 138 | CLOSED | CLOSED | CLOSED | CLOSED | CLOSED | OPEN |

FIG. 4

METHOD AND APPARATUS FOR SUPPLYING FEEDWATER TO A FORCED FLOW BOILER

BACKGROUND OF THE INVENTION

1. Field of the Invention

The present invention relates to feedwater supply systems for forced-flow boilers. More particularly, the invention relates to control systems for positive displacement feedwater pumps and a method for supplying feedwater to forced-flow boilers.

2. Description of the Prior Art

Boilers for generating steam can be of the fire-tube type in which the combustion gases are circulated through tubes immersed in a container of water or of the forced-flow type in which water is circulated through tubes which are exposed to the combustion gases. In the former type, the level of water in the container is normally controlled by means of a simple float valve. However, in the latter type, one or more pumps force the water through the tube or tubes at a rate commensurate with the demand for steam. Controlling the rate at which feedwater is provided to such boilers is difficult because of the high pressure (and often high temperatures where condensation from a steam separator is returned to the pump inlet) at which the water must be supplied.

Forced-flow boiler systems for generating steam at a variable rate must include means for controlling the source of heat (i.e., the fuel and air flow to a burner), as well as the water supplied to the heating coil. Controlling the fuel by means of conventional modulating valves and the air by means of conventional dampers is a simple task compared to controlling the amount of water supplied to the boilers. While both variable and constant displacement pumps have been used for supplying the feedwater, constant displacement pumps have an advantage of providing a predetermined output under changing pressure conditions.

A diaphragm-type pump in which an electric motor drives reciprocating pistons within a pump housing, which in turn force hydraulic oil against flexible diaphragms for displacing the water, has been found to be particularly suitable for supplying feedwater to forced flow boilers. Individual pump sections (piston and cylinder) can be disabled through solenoid bypass valves, thereby controlling the pump output in increments related to the number of pump sections, i.e., $\frac{3}{4}$, $\frac{1}{2}$ or $\frac{1}{4}$ output for a four-section pump. Tubular water columns separate the pump head or diaphragms from check valves positioned between an inlet and outlet manifold to keep excessive temperatures from the diaphragms.

Where the amount of water demanded cannot be accommodated by disabling one or more sections of the pump, e.g., 60% of the total pump output, a water bypass valve can be operated to return a portion of the water to the pump inlet. The water bypass valve functions as a modulating valve to accurately supply the required amount of water. Such bypass valves have a tendency to leak and require considerable maintenance because of scale buildup and wear due to solid particles carried by the high temperature water.

As an alternative to the use of water bypass valves, the prior art has used a step control in which the steam output is controlled by turning off (completely or partially) the water, fuel and air flow when the steam pressure reaches one value and turning the fuel, water and air back on when the steam pressure drops to a second value. While such step control systems are less expensive than full modulation control systems, they suffer from several disadvantages.

First, the steam pressure will fluctuate over a considerable range. Second, where the fuel is turned off completely, the combustion chamber must be purged of any residual gases or fuel before it can be refired. While the prepurge period may require only a matter of seconds in a small boiler, i.e., 100–200 horsepower (h.p.), it may require several minutes for a large boiler, i.e., 500 or more h.p. Such a large time delay may result in an excessive drop in steam pressure.

Another alternative to the use of water bypass valves is the use of a hydraulic-actuated diaphragm pump in which the travel of the individual diaphragms (and therefore the quantity of water pumped) is controlled by varying the quantity of hydraulic fluid delivered to the diaphragms. A pump of this type is described in U.S. Pat. No. 3,972,654. While such pumps have been successful in accurately controlling the delivery of feedwater and eliminating the leakage problem of water bypass valves, they are expensive to manufacture.

These and other disadvantages of the prior art feedwater control systems for forced-flow boilers have been overcome by the present invention.

SUMMARY OF THE INVENTION

The apparatus of the present invention includes a positive displacement pump with a water inlet and an outlet and a plurality of discrete pumping elements. Each pumping element is arranged to pump a predetermined quantity of water from the inlet to the outlet during each cycle of the pump. Disabling means are associated with each pumping element for selectively defeating the pumping action of the associated pumping element.

The invention further includes control means responsive to the demand for water in the boiler within a preset range for controlling at least one of the disabling means to periodically defeat the pumping action of the associated pumping element at a predetermined cyclic rate and with a duty cycle (i.e., pumping time divided by the time for one cycle) that varies in accordance with the demand for water.

In accordance with the method of the present invention, fuel is supplied to a burner of the boiler in a continuous manner and the rate of fuel flow is monitored to determine the water flow rate required by the boiler. The positive displacement pump, which includs a plurality of discrete pumping elements, is operated to supply water to the boiler and at least one of the pumping elements is disabled on a periodic basis with a variable duty cycle with the duty cycle bearing a relationship to the demand for water.

BRIEF DESCRIPTION OF THE DRAWINGS

FIG. 4 is a chart illustrating the operation of the pump of FIGS. 2 and 3 in accordance with the present invention;

DESCRIPTION OF THE PREFERRED EMBODIMENT

Figure 1:
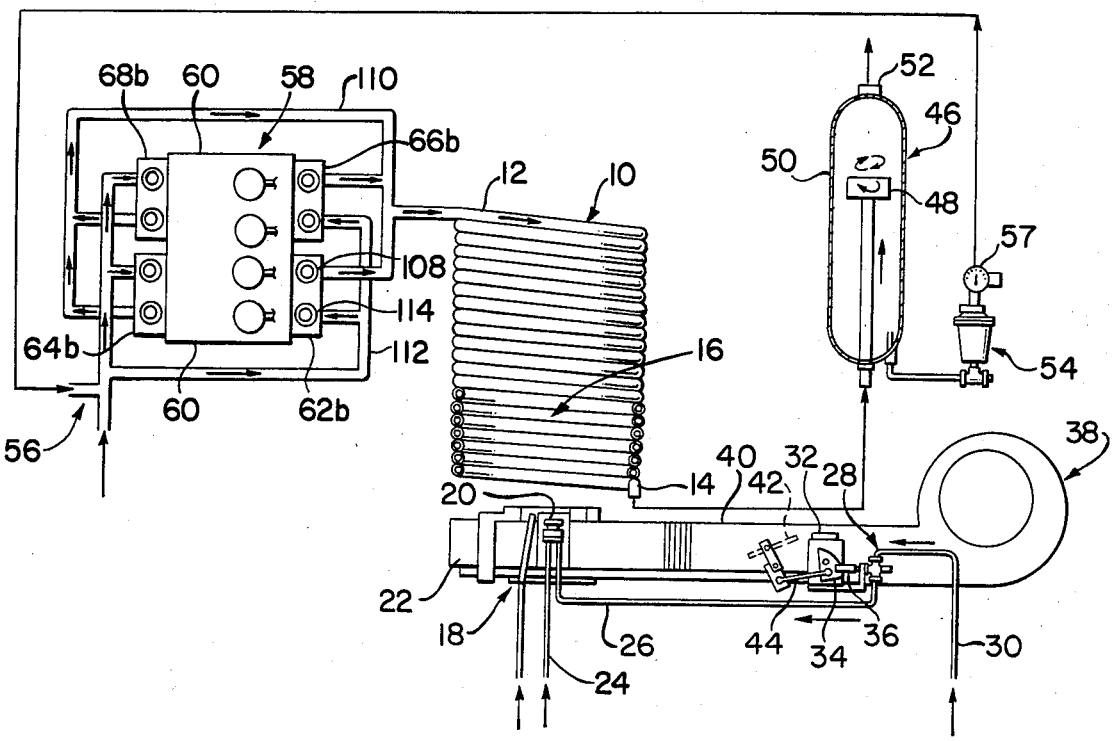
FIG. 1 is a diagrammatic view of a forced feed boiler system for which the present invention is particularly useful.

The present invention is directed to feedwater control systems for forced-flow boilers and a method of supplying feedwater to such boilers. Referring particularly to FIG. 1, the system includes a water tube boiler 10 having a water inlet 12 and a steam outlet 14. The lower portion of the boiler 10 surrounds a combustion chamber 16. A burner 18 is positioned at the lower end of the boiler and includes an oil nozzle 20 for atomizing the fuel oil and a voluted end 22 which projects upwardly into the interior of the tube boiler. Air to atomize the fuel is supplied from a suitable source (not shown) via conduit 24. Oil is supplied to the burner 18 by means of supply tube 26 and a modulating fuel control valve 28 from a suitable source of oil under pressure (not shown) connected to the end 30 of the supply tube to control valve 28.

Figure 3:
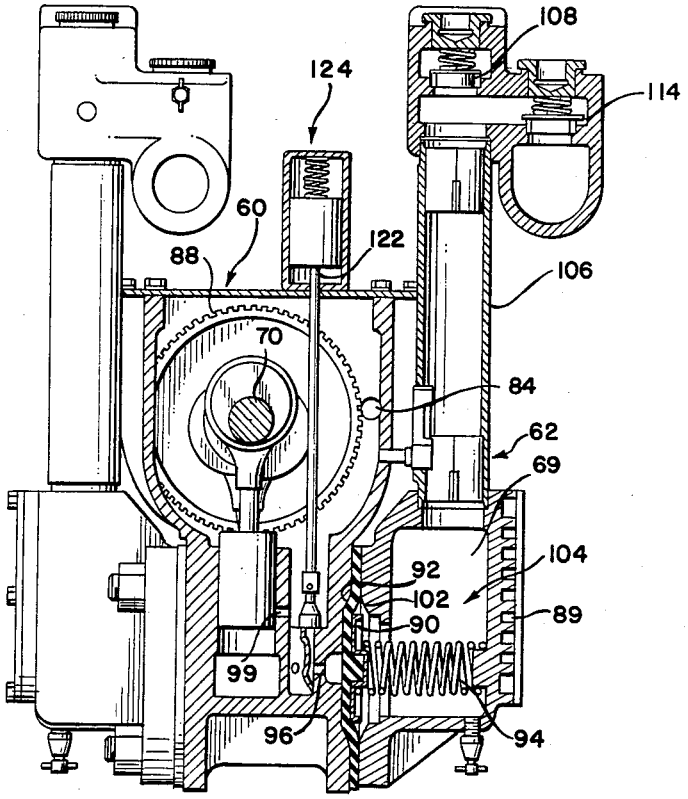
FIG. 3 is an end cross-sectional view of the pump of FIG. 2.

The modulating fuel control valve 28 is illustrated in FIG. 3 of U.S. Pat. No. 3,972,654, assigned to the assignee of the present invention. The valve 28 includes a servo motor 32 which controls the rotational position of a cam plate 34, the linear position of a valve stem 36 by means of a cam follower (not shown) and the position of the wiper of a potentiometer 43 shown in FIG. 5. The valve stem in turn controls the flow of oil through the tube 26 in accordance with the position of the cam plate 34. The servo motor 32 can be controlled by an operator, for example, by means of a potentiometer or it can be made a part of a feedback system (not shown) which responds to the power demands of the boiler. The function of the servo motor 32 and modulating valve 28 is to accurately control the flow of oil to the burner to provide the heat required to produce the amount of steam desired or demanded. The function of the potentiometer 43 is to provide a control signal to the system for supplying feedwater to the boiler 10, as will be explained in connection with FIG. 5.

A blower 38 supplies air to the combustion chamber 16 through a conduit 40. A modulating air damper blade 42 is connected to the cam plate 34 by linkage 44 to control the quantity of air entering the combustion chamber in accordance with the amount of fuel flowing through the valve 28.

Steam leaving the outlet 14 of the heating coil or boiler 10 is directed to a steam separator 46 which includes a separating nozzle 48 located within a pressure vessel 50. The steam is discharged through an outlet 52. A steam trap 54 returns excess water (condensate) from the separator to a hotwell (not shown) and then to the inlet manifold 56 of a feedwater pump 58. The trap 54 includes a valve 57 which periodically opens to return a given quantity of the condensate to the hotwell or pump inlet manifold 56.

Figure 2:
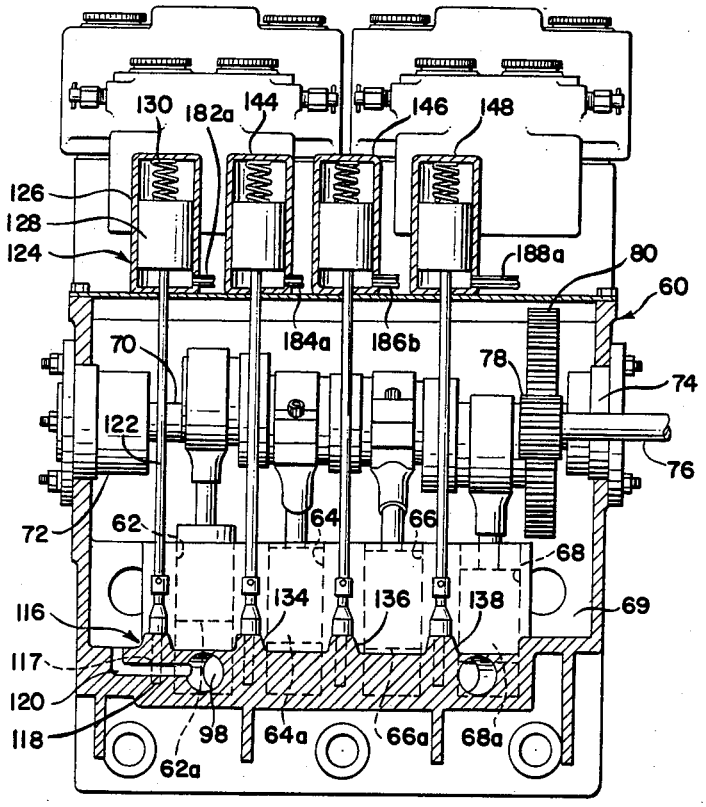
FIG. 2 is a cross-sectional view of the feedwater pump utilized in the system of FIG. 1.

Referring now to FIGS. 1, 2 and 3, the pump 58 includes a casing 60 which houses four cylinders 62, 64, 66 and 68, and a crankcase 69 filled to an appropriate level with hydraulic fluid or oil. Pistons 62*a*, 64*a*, 66*a* and 68*a* are connected to a crankshaft 70 by means of suitable connecting rods as shown. The crankshaft is journaled in bearings 72 and 74. A pinion shaft 76 carrying a helical spur gear 78 extends through the casing 60. The spur gear 78 drives a main gear 80 keyed to the crankshaft 70. Water chambers 62*b*, 64*b*, 66*b* and 68*b* are associated with cylinders 62, 64, 66 and 68, respectively.

As is shown in FIG. 3, each water chamber includes a housing 89 and a flexible diagram 90 which is urged against a first seat 92 formed in the pump casing 60 by means of a coil spring 94. A hydraulic chamber 96 is disposed on the side of the diagram 90 opposite the spring 94. The hydraulic chamber 96 is connected to the bottom of the cylinder 62 via a port 98, as is shown in FIG. 3. The cylinder 62 receives oil from the crankcase 69 through port 99 when the piston 62*a* is in the uppermost position. When the piston 62 is moved downwardly, oil is forced into the hydraulic chamber 96 and the diagram 90 is moved toward a seat 102 formed in the housing 89, thereby compressing the spring 94 and forcing water within a water chamber 104 up through a stand pipe 106. The water exits through a check valve 108 into an outlet manifold 110 and then into the boiler tube inlet 12. Water is supplied to the water chamber 104 and stand pipe 106 from an inlet manifold 112 through check valve 114, as illustrated in FIGS. 1 and 3. The water chambers 64*b*, 66*b* and 68*b* are identical to chamber 62*b* just described.

A bypass valve 116 consisting of a cylindrical bore 117 and mating valve core 118 seated therein serve to selectively bypass oil from the cylinder 62 back into the crankcase 118 to thereby defeat the pumping action of the pumping element consisting of the cylinder 62, piston 62*a* and water chamber 62*b*, as will be described.

The bypass valve 116 connects the port 98 and hydraulic chamber 96 with the crankcase 69 through a passageway 120. A bypass rod 122 is connected between the valve core 118 and a pneumatic cylinder 124. The pneumatic cylinder 124 includes a cylindrical enclosure 126, an actuating piston 128 and a return spring 130. The enclosure has an air inlet line 182*a* for receiving air under pressure from a valve 182 shown in FIG. 5, as will be described.

Each hydraulic piston and cylinder combination 64/64*a*, 66/66*a* and 68/68*a* is provided with a separate bypass valve (marked 134, 136 and 138 as shown) of identical construction to that just described. Air actuators 144, 146 and 148 operate the valves 134, 136 and 138, respectively. Each hydraulic piston/cylinder combination with its associated water chamber forms a discrete pumping element which can be selectively disabled by the associated bypass valve.

A two-cylinder pump of the type illustrated in FIGS. 2 and 3 is described in the Instruction Manual for Steam Generator Model E-100 published by the assigned of this application, Clayton Industries, Inc. ("Clayton"). A four-cylinder pump with only two bypass valves is described in Clayton's Instruction Manual for the E-300 model steam generators. Two of such pumps have been used in the present invention with two cylinders and their associated bypass valve forming one pumping element. Other types of positive displacement pumps may be used in the disclosed system. For example, duplex and triplex plunger pumps manufactured by Worthington Corporation of Harrison, N.J. would be suitable providing that suitable bypass valves are incorporated in the pumps to enable the cylinders to be selectively disabled.

FIG. 4 illustrates the manner in which the hydraulic fluid bypass valves 116, 134, 136 and 138 are controlled to meet six different examples of water demand. In the first column where the maximum water is demanded, all valves are closed, and as a result, no pumping element is disabled. The pump 60 is therefore delivering its full rated output of water to the boiler.

Column 2 of FIG. 4 illustrates the operation of the bypass valves when the demand for water is 80% of the rated output. The valves 134, 136 and 138 remain closed, but valve 116 is cycled from a closed to an open position on a periodic basis. The particular period chosen will depend upon the allowable variation in steam pressure and the wear on the valves to be tolerated. A period of between 10 and 60 seconds, and preferably about 30 seconds, has been found to provide good results for a boiler system having a rated output of 500 horsepower. Valve 116, for the example in column 2, is operated with a 20% duty cycle; that is, for each period of 30 seconds, the valve is closed for 6 seconds and open for 24 seconds. The pumping element comprising cylinder 62, piston 62*a* and water chamber 62*b* is thus enabled 20% of the time and disabled 80% of the time, delivering one-fourth of its rated output. The pump 60 thus delivers 80% of its maximum rated output.

In the example shown in columns 3, 4, 5 and 6 of FIG. 4, the pump is operated at 65%, 50%, 35% and 20%, respectively, of its rated capacity. The valves 116, 134, 136 and 138 are operated as illustrated.

Figure 5:
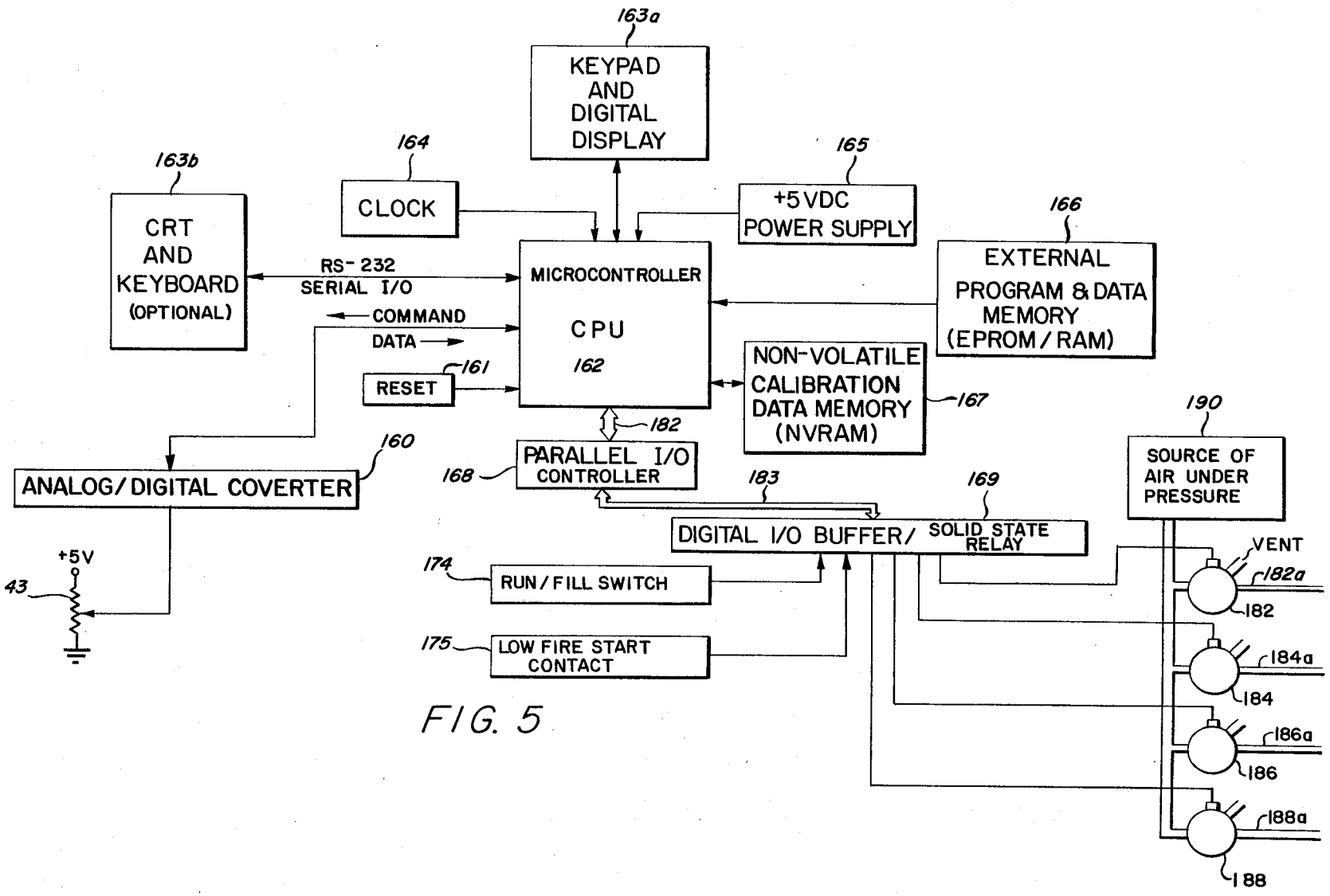
FIG. 5 is a block diagram of an automatic control system for the pump of FIGS. 2 and 3 in accordance with the present invention.

Referring now to FIG. 5, a microcomputer or microcontroller (CPU) 162 is used to control the bypass valves 116, 134, 136 and 138. The CPU 162 and its associated circuitry are powered from a suitable +5 volts DC power supply 165. An oscillator clock circuit 164 is connected to the CPU 162 to provide the necessary timing for functions internal to the CPU. A reset switch 161 is connected to the CPU to restart the program at any time. A digital display and keypad 163*a* are connected to the CPU 162 in a conventional manner. Optionally, a cathode ray tube terminal and keyboard 163*b* may be connected to CPU 162 using an RS-232 serial I/O protocol. The program for the CPU may be stored internally or externally in an external program and data memory 166. In addition, nonvolatile calibration data memory unit 167 may be used to store data entered by the operator through the keyboard or keypad. A parallel I/O controller 168 is used to provide input and output of digital signals to and from CPU 162 via parallel busline 182. A digital I/O buffer/solid-state relay assembly 169 is used to interface directly with digital input and output hardware to be described subsequently. Analog data is obtained through the analog-to-digital converter 160 and sent to CPU 162 upon command from the CPU.

The generalized operation of the control system illustrated in FIG. 5 is as follows: Upon power-up of the system, the CPU 162 resets and initializes itself to a starting condition. The program then begins to execute and it, in turn, initializes analog-to-digital converter 160 and parallel I/O control 168 so that they will start in a safe operating condition. The program requires CPU 162 to obtain certain calibration data from the nonvolatile calibration data memory 167 and immediately obtain the position of the load potentiometer 43 by causing the analog-to-digital converter 160 to convert the potentiometer analog signal to a digital value and communicate that value to CPU 162. Subsequently, the CPU requires digital inputs which are in the form of contact opens or closures (0's or 1's) from a run-fill switch 174 and a low-fire start relay 175. The run-fill switch 174 is a manual switch which allows the operator to fill the boiler coil 10 before the burner is turned on. To accomplish this task, the operator can simply move the switch to the fill position for a predetermined period of time to ensure that there is adequate water within the boiler to prevent damage to the coil when the burner is turned on. The run-fill switch 174 controls the low-fire start relay 175 and prevents its actuation until the run-fill switch 174 is moved to the run position. In the on position the low-fire start relay allows the burner 20 to be fired at an initial rate of 20%. Clayton's Instruction Manual for the E-100 series stream generator provides a more detailed description of the use of a run-fill switch and low-fire start relay in a steam generator system assembly.

Depending on the setting of the run-fill switch and the low-fire start relay, the CPU 162 will cause the parallel I/O controller 168 to output a digital signal to digital I/O buffer/solid-state relay 169 which will actuate some combination of solenoid valves 182, 184, 186 and 188, in turn, causing bypass valves 116, 134, 136 and 138 to be actuated from air pressure provided to airlines 182*a*, 184*a*, 186*a* and 188*a*.

Each valve 182, 184, 186 and 188, upon receiving an output signal from the I/O relay 169, switches its associated air outlet conduit 182*a*, 184*a*, 186*a* or 188*a* from a source of air under pressure 190 to atmosphere. The air lines 182*a*, 184*a*, 186*a* and 188*a* are connected to air actuators 124, 144, 146 and 148, respectively, as is shown in FIG. 3. For a water demand falling between 100% and 75% of the maximum, the three air actuators 144, 146 and 148 and their associated bypass valves 134, 136 and 138 are maintained in the closed position, as is illustrated in FIG. 3. For water demands falling between 75% and 50%, the valve 184 connects the air actuator 144 to the air pressure source 190 which causes the piston therein to move upwardly against the spring and open the bypass valve 134, thereby disabling the pumping element, consisting of cylinder 64, piston 64*a* and the associated water chamber. When the water demand drops below 50% and 25%, respectively, the bypass valves 136 and 138 are opened. It should be noted that when the run-fill switch 174 is in the fill position, the output signal applied to the solenoid valves 182, 184, 186, and 188 is such that the water flow from pump 60 is proportional to the position of potentiometer 43, but not less than about 20%, to ensure that water fills the coil 10.

As discussed with respect to FIG. 4, the bypass valve 116 associated with the pumping element comprising cylinder 62, piston 62*a* and water chamber 62*b* is operated to provide a fine adjustment of the water demand, i.e., percentages above 75%; between 75%–50%; between 50%–25%; and less than 25%. For this purpose, the CPU program adjusts the duty cycle of valve 116 by applying an output signal from parallel I/O port 168 to the electrically operated pneumatic valve 182. The valve 182 connects the air actuator 124 to atmosphere when an output signal is present on lead 193. At all other times, the valve 182 connects the air actuator to atmosphere, keeping the bypass valve 116 closed.

Figure 6:
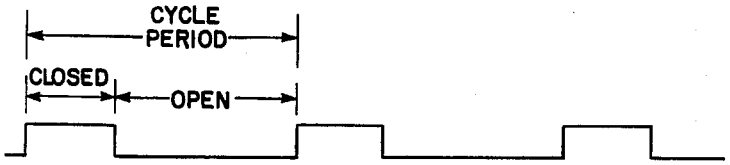
FIG. 6 is a waveform diagram illustrating the operation of one of the pumping elements of the pump of FIGS. 2 and 3.

FIG. 6 illustrates the operation of the pumping element comprising cylinder 62, piston 62*a* and water chamber 62*b*. A high value of the waveform represents full pumping action with the bypass valve 116 closed and a low value represents no pumping action with the bypass valve open.

Having initiated operation of one or more of the solenoid valves, the program causes the computer to repeat the cycle just described and, in addition, to output data to the CRT 163*b* or digital display 163*a* and to store certain data in nonvolatile memory 167.

The specific operation of the control system described is illustrated in more detail in the following table which provides a listing of a BASIC language program used by CPU 162.

I
PROGRAM TABLE

```
A. MICROCOMPUTER BOILER CONTROL SYSTEM BASIC LANGUAGE PROGRAM
003 'an apostrophe (') begins a comment; a colon (:) separates commands
005 'MLOOPS=number of real time machine (CPU) loops in 10 seconds
010 'A(0)-A(4)=scalar for the states of the output signals to the solenoid valves (182, 184,
    186, 188)
015 'h=hexadecimal value or address; "slash" (/) implies integer division
020 'TIMER=a timer based on MLOOPS, which times the duty cycle
025 'FLOW=computed water flow rate in % based on potentiometer 43 output and flow factor
    (FF)
030 'FF=water flow factor in % of full scale; to scale down pump flow
035 'DUTY=cycle time in seconds for one complete duty cycle
040 'POT=digitized value of potentiometer 43 output: 0-255 = 20-100% firing rate (or water
    demand), respectively
045 'MINACT=minimum actuation time for a solenoid in seconds
050 'CYLON=number of pump cylinders 64, 66, 68 which are on (i.e., does not include
    cylinder 62 which is subject to being cycled)
055 'ONTIME=an ON cycle timer during which CYLON+1 cylinders are ON
060 'LFS=low fire start relay position: 0 = closed = no fire, 1 = open = fire
065 'RFS=run/fill switch position: 0 = closed = run, 1 = open = fill
070 'I=a timer to actuate solenoid valves for MINACT, e.g., 1 second
075 'BCYL=previous value of CYLON for comparison with new value of CYLON
080 'PPORTx=parallel input/output port (I/O 169): x = 0 signifies a command or input to
    I/O 169; x = 1 signifies an output to solenoid values (182, 184, 186, 188); x = 2
    signifies a command output or digital input to analog-to-digital converter 160
085 'PUMP=command to pump for number of cylinders to be pumping
090 SBUF=internal computer address of last character received by CPU from 163b
B. INITIALIZATION MODULE
110 MLOOPS=10:A)(0)=15:A(1)=7:A(2)=3:A(3)=1:A(4)=0          ' define machine loop & scalars
120 SBUF=99h:FF=100:DUTY=30:MINACT=1                        ' initialize input variables
125 PPORT0=7000h:PPORT1=7001h:PPORT2=7002h                  ' initialize port addresses
130 PUMP=7:TIMER=0:LFS=0:POT=0:FLOW=20:                     ' initialize cyl #1 to 20% rate
    RFS=8:MINACT=1
140 POKE PPORT0,91h:POKE PPORT1,PUMP                        ' initialize PPORT & pump
145 GOTO 170                                                ' don't allow inputs unless operator
                                                            enters ESC key input
150 INPUT "Enter flow factor (85-100%)";FF                  ' water flow scale factor
155 IF FF<85 OR FF>100 GOTO 150                             ' edit water factor
160 INPUT "Enter cycle time (10-60s)";DUTY                  ' cycle time, nominal = 20s
165 IF DUTY<10 OR DUTY>60 GOTO 160                          ' edit duty cycle time
170 DUTY=DUTY*MLOOPS/10                                     ' compute true cycle time
180 MINACT=MINACT*MLOOPS/10                                 ' compute true delay time
C. CONTROL LOOP MODULE
200 TIMER=TIMER+1:IF TIMER>DUTY THEN TIMER=1                ' increment counter, rst if maxd
210 FLOW=FF*(20+16*POT/51)/100                              ' calc % flow from ADC
220 CYLON=FLOW/25:ONTIME=(FLOW-CYLON*25)*DUTY/25            ' calc cyls # on, # loops CYLON+1 on
225 IF TIMER<=ONTIME THEN CYLON=CYLON+1                     ' if <ONTIME turn on CYLON+1
230 IF LFS=0 and RFS=0 THEN CYLON=0:PRINT "NO FIRE"         ' LFS closed, no pumping
235 IF RFS=<>0 THEN PRINT "FILLING"                         ' RFS open so fill coil
240 IF I=MINACT THEN I=0                                    ' reset delay if maximum
245 IF I>0 THEN I=I+1: GOTO 260                             ' delay, so leave cyls on
250 IF BCYL<>CYLON, THEN I=1                                ' new cyl, so restart delay
255 PUMP=A(CYLON)                                           ' cyl value = PUMP
260 BCYL=CYLON                                              ' save CYLON for next loop
265 PRINT "LOAD=";(POT*100)/255;"%" FLOW="; FLOW            ' print values on crt
270 POKE PPORT2;0:POKE PPORT2,80h:POKE PPORT1,P             ' address ADC, convert, command pump
275 POKE PPORT2,10h:CAM=PEEK(PPORT0)                        ' enable out & read ADC (pot)
280 RFS=08h AND PEEK(PPORT2)                                ' mask RFS bit
285 LFS=04h AND PEEK(PPORT2)                                ' mask LFS bit
290 IF PEEK(SBUF)=027 GOTO 150                              ' ESC so allow inputs
295 GOTO 200                                                ' loop forever
300 STOP                                                    ' error if this executes
```

The above program table is self-explanatory. Lines 3–85 are nonexecuting remarks (REM's in BASIC) which refer to variables or functions. Lines 110–180 are executable statements which manipulate variables and constants. Each line is followed by a remark which describes action of the statements in the line. Lines 200–300 implement data acquisition, computation and control of the feedwater pump 60. It should be noted that the symbol * is used as a multiplication sign. Thus line 210 signifies that the constant 16 is multiplied by the digital value of the potentiometer 43 output and divided by the constant 51, and the result is subtracted from the constant 20 with the resultant value multiplied by the water flow factor FF, which is normally set at 100%. The resultant value is then divided by 100 to provide the water flow demanded in percent. For example, if the potentiometer 43 output is set at its midpoint (half of its output voltage), i.e., a digital value of 128, then water flow is computed by:

$$\text{FLOW} = \frac{100\%\left(20 + \frac{16*128}{51}\right)}{100} = \frac{100\%}{100}(20 + 40) = 60\%$$

With a 60% water demand CYLON in line 220 would equal 60/25 or 2 and ONTIME would equal $$\frac{(60 - 2*25)\ 30}{25}$$

or 12 seconds where the cycle time is 30 seconds.

Additional analog-to-digital channels and digital inputs or outputs could be added to the system of FIG. 5, contingent upon the ability of the hardware to accommodate them, and changes in the program could be made to accommodate such hardware changes. It is, of course, understood that languages other than BASIC could be used to accomplish exactly the same objective of the BASIC program.

The computerized control system previously described and illustrated in FIG. 5 can be made from the following commercially available components. To optimize performances of the control system, components may be exchanged or replaced with different components, without departing from the spirit and scope of the invention.

| COMPONENT | REFERENCE | MANUFACTURER | MODEL |
|---|---|---|---|
| CPU | 162 | Intel | 8051, 8031 or 8751 |
| Clock | 164 | M-TRON | MP-1 12 MHz |
| Parallel I/O | 168 | Intel | 8255 |
| Power Supply | 165 | Condor | B5-3/OVP |
| External EPROM | 166 | Intel | 2732A |
| External RAM | 166 | Texas Instruments | TMS4016 |
| NVRAM | 167 | XICOR | X2044P |
| Analog/Digital Converter | 160 | National Semiconductor | ADC0808 |
| CRT/Keyboard | 163b | Beehive | DMIS |
| Keypad | 163a | Microswitch | 16SD Series |
| Digital Display | 163a | General Instruments | MMN36000 Series |
| Solid-State Relays | 169 | Opto 22 | Various |
| Load Potentiometer | 43 | New England Instruments | F78SD103 |
| Solenoid Valve | 212 | General Controls | S303AF02V3BC5E |
| Bypass Valve | 116 | Clayton Industries | UH-60658 |

Numerous additional components, such as resistors, capacitors, CPU support integrated circuits, connectors, sockets, printed circuit cards, etc., are also required, as will be readily understood by those skilled in the art.

There has been described a method and apparatus for supplying feedwater to a forced flow boiler and the like which overcomes the disadvantages of the prior art. Various modifications to the preferred method and embodiment will be apparent to those skilled in the art without departing from an enabled to a disabled condition to supply the correct amount of water. Where more than one pumping element is cycled, it is preferred that the elements be cycled sequentially instead of simultaneously. Further modifications might include cycling of only two pumping elements in a 2- or 4-piston pump, or even 6 or 8 pumping elements in a pump with as many pistons. Acquisition of additional data or output of additional digital commands may also be included in the described embodiment to enhance its operation or functionality.

What is claimed is:

1. In a feedwater control system for supplying water to a forced flow boiler or the like in which combustion gases are used to heat the water, the combination which comprises:

(a) a positive displacement pump having a water inlet, an outlet, a plurality of discrete pumping elements with each pumping element being arranged to pump a predetermined quantity of water from the inlet to the outlet during each cycle of the pump, and disabling means associated with each pumping element for selectively defeating the pumping action of the associated pumping element, and (b) control means responsive to the demand for water in the boiler within a preset range for controlling at least one of the disabling means to periodically defeat the pumping action of the associated pumping element at a predetermined cyclic rate and with a duty cycle that varies in accordance with the demand for water in the boiler.

2. The combination as defined in claim 1 wherein each pumping element includes a piston in communication with a first chamber, a cylinder and a flexible diaphragm disposed within a second chamber, the piston being arranged to pump fluid from the first chamber through the cylinder and into the second chamber to move the diaphragm and force water from the inlet to the outlet, and wherein each disabling means comprises a bypass means having a valve which, when open, selectively connects the first and second chambers to thereby prevent movement of the diaphragm.

3. The combination as defined in claim 2 wherein the boiler includes a burner with a fuel regulator and the means for controlling the bypass means is responsive to the fuel flow to the burner.

4. The combination as defined in claim 3 wherein the pump comprises four pumping elements and wherein the control means is arranged to periodically open and close the valve in only one bypass means at a time.

5. The combination as defined in claim 4 wherein the control means is arranged to maintain the valve in one bypass means open when the water demand falls within first preset limits.

6. The combination as defined in claim 5 wherein the control means is arranged to maintain the valve in a second bypass means open when the water demand falls within second preset limits.

7. The combination as defined in claim 5 wherein the control means is arranged to maintain the valve in a third bypass means open when the water demand falls within third predetermined limits.

8. The combination as defined in claim 8 wherein the control means is arranged to open and close the valve in the fourth bypass means on a periodic basis in accordance with the water demand.

9. The combination as defined in claim 8 wherein the duty cycle of the valve in the fourth bypass means is less than one minute.

10. The combination as defined in claim 9 wherein the duty cycle of the valve in the fourth bypass means is about 30 seconds.

11. In a feedwater control system for supplying water to forced flow boilers, steam generators and the like wherein the fuel to a burner is controlled in accordance with the quantity of steam desired and water required by the boiler, the combination which comprises:

(a) a positive displacement pump for pumping water betwen an inlet and an outlet, the pump having a plurality of discrete pumping elements, each pumping element having a water chamber connected between the inlet and outlet, a piston and cylinder, a first chamber containing a supply of pumping fluid, a second chamber and a flexible diaphragm connected between the second chamber and the water chamber, the piston being arranged to pump fluid from the first chamber through the cylinder and into the second chamber whereby the diaphragm is moved to displace water within the water chamber to pump a predetermined quantity of water from the inlet to the outlet for each complete cycle of the piston, the pump further including a bypass valve individually associated with at least some of the pumping elements, the bypass valve being constructed and arranged to connect the first and second chambers when open to thereby prevent movement of the diaphragm of the associated pumping element, and (b) control means for monitoring the fuel flow to the burner for alternately opening and closing at least one of the bypass valves at a periodic rate with the open to closed time bearing a relationship to the fuel flow rate.

12. The combination as defined in claim 11 wherein the pump includes at least first and second pumping elements with each element equipped with a bypass valve and wherein the control means is arranged and constructed to maintain the bypass valve of the first pumping means open when the fuel flow rate is between first preset limits and open when the fuel flow rate is between second preset limits and to cycle the bypass valve of the second pumping means open and closed with a duty cycle that varies in accordance with the fuel flow rate and the open or closed condition of the bypass valve of the first pumping means.

13. The combination as defined in claim 12 wherein the pump includes third and fourth pumping elements and the control means is arranged and constructed to maintain the bypass valves of the third and fourth pumping means open when the fuel flow rate is between third and fourth limits, respectively, and closed when the fuel flow rate is between fifth and sixth limits.

14. The combination as defined in claim 13 wherein the control means is arranged and constructed to cycle the bypass valve of the second pumping element over a period of between 10 and 60 seconds.

15. The method of supplying feedwater to forced flow boiler, steam generator or the like, wherein the fuel to a burner for heating the water within the boiler is controlled in a continuous manner in accordance with the quantity of steam desired and wherein a positive displacement pump having a plurality of discrete pumping elements is connected between the boiler and a source of feedwater to provide water to the boiler, comprising:

(a) monitoring the rate of fuel flow to the burner to determine the water flow rate required by the boiler;

(b) operating the feedwater pump;

(c) disabling a selected number of the pumping elements so that the rate of water supplied by the remaining elements, if operated continuously, would just exceed that required; and (d) disabling at least one of the remaining pumping elements on a periodic basis so that the ratio of the time that the element is enabled to the time for one period multiplied by the water flow rate supplied said element, if operated continuously, equals difference between the total demand rate for water and the rate supplied by the remaining pumping elements enabled on a full-time basis.

16. The method of claim 15 wherein only one pumping element is disabled on a periodic basis at any time.

17. The method of claim 16 wherein the period over which said one of the remaining elements is enabled and disabled is between 10 and 60 seconds.

18. The method of supplying feedwater to forced flow boiler wherein the flow of fuel to a burner is controlled in a continuous manner in accordance with the quantity of steam desired and wherein a positive displacement pump having a plurality of discrete pumping elements is connected between the boiler and a source of feedwater, the pump having means associated with each pumping element for selectively disabling the pumping action of said element, comprising:

(a) monitoring the rate of fuel flow to the burner to determine the water flow rate required by the boiler;

(b) operating the feedwater pump to supply water to the boiler; and (c) disabling at least one of the pumping elements on a periodic basis with a variable duty cycle, the duty cycle bearing a relationship to the demand for water.

19. The method of claim 17 including disabling each of said remaining pumping elements when the fuel flow rate fails within preset limits whereby the water supplied by the enabled elements when added to the water supplied by the element disabled on a periodic basis equals the water required by the boiler.

20. The method of claim 19 wherein the period of operation of said one pumping element is between 10 and 60 seconds.

21. The method of supplying feedwater to a forced flow boiler wherein the flow of fuel to a burner is controlled in a continuous manner in accordance with the quantity of steam desired and wherein a positive displacement pump having a plurality of discrete pumping elements is connected between the boiler and a source of feedwater, the pump having means associated with each pumping element for selectively disabling the pumping action of said element, comprising:

(a) determining the water flow rate required by the boiler;

(b) operating the feedwater pump to supply water to the boiler; and (c) disabling at least one of the pumping elements on a periodic basis with a variable duty cycle, the duty cycle bearing a relationship to the demand for water.

22. The method of claim 21 including disabling a selected number of said remaining pumping elements on a continuous basis when the water flow rate required by the boiler falls within preset limits whereby the water supplied by the enabled elements when added to the water supplied by each element disabled on a periodic basis equals the water required by the boiler.

23. The method of claim 22 wherein the period of operation of said each pumping element disabled on a periodic basis is between 10 and 60 seconds.

* * * * *